US009833998B1

(12) United States Patent
Deboard et al.

(10) Patent No.: US 9,833,998 B1
(45) Date of Patent: Dec. 5, 2017

(54) ADAPTIVE PRINT HEAD MAINTENANCE

(71) Applicant: Funai Electric Co., Ltd., Osaka (JP)

(72) Inventors: Bruce A Deboard, Georgetown, KY (US); Stephen T Olson, Lexington, KY (US); Lucas D Barkley, Lexington, KY (US); Shingo Setono, Nara (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 15/165,039

(22) Filed: May 26, 2016

(51) Int. Cl.
*B41J 2/165* (2006.01)

(52) U.S. Cl.
CPC ..... *B41J 2/16535* (2013.01); *B41J 2/165* (2013.01); *B41J 2/16517* (2013.01); *B41J 2/16552* (2013.01)

(58) Field of Classification Search
CPC ..... B41J 29/393; B41J 2/16535; B41J 2/165; B41J 2/16517; B41J 2/16552
See application file for complete search history.

(56) References Cited

U.S. PATENT DOCUMENTS

2002/0126308 A1 9/2002 Uetsuki
2003/0081035 A1 5/2003 Van Veen
2003/0214547 A1* 11/2003 Sukigara ..... B41J 2/465 347/23
2004/0233247 A1* 11/2004 Yamada ..... B41J 2/16526 347/23
2006/0197799 A1* 9/2006 Sato ..... B41J 2/16547 347/33
2006/0284922 A1* 12/2006 Beak ..... B41J 2/16585 347/23
2008/0192074 A1 8/2008 Dubois
2009/0016744 A1* 1/2009 Kolb ..... G03G 15/55 399/24
2009/0109258 A1* 4/2009 Nitta ..... B41J 2/16535 347/33
2015/0190967 A1 7/2015 Stava
2015/0298394 A1 10/2015 Sheinman

* cited by examiner

*Primary Examiner* — Sharon A Polk
(74) *Attorney, Agent, or Firm* — Luedeka Neely Group, P.C.; Rick Barnes

(57) ABSTRACT

A method of operating an ink jet printer with an included printer controller, where the ink jet printer prints using a replaceable print head that includes a nozzle plate and an ink reservoir. The printer controller tracks a usage of ink from the ink reservoir and a number of completed nozzle plate wiping operations. The print controller determines, prior to initiating each nozzle plate wiping operation, whether to initiate an inter-layer spitting operation instead of the nozzle plate wiping operation. The printer controller initiates the determined one of the wiping operation and the spitting operation.

13 Claims, 4 Drawing Sheets

| 1 | 2 | 3 | 4 | 5 | 6 | 7 | 8 | 9 |
|---|---|---|---|---|---|---|---|---|
| Layer Time (seconds) | Bottle Type | Std Fill Critical Dot Rate per page | 1XL Fill Critical Dot Rate per page | 2XL Fill Critical Dot Rate per page | 3XL Fill Critical Dot Rate per page | Modifier | Dot Consumption Region | Cap or Spit Decision |
| 0-35 | Color | 370,021 | 740,042 | 1,027,836 | 2,220,126 | > Than | Depleted | Spit |
| | | | | | | < Than | Degraded | Spit |
| | Mono | 440,883 | 881,766 | 1,322,649 | 2,645,298 | > Than | Depleted | Spit |
| | | | | | | < Than | Degraded | Spit |
| | Color & Mono | Ink Rates | Ink Rates | Ink Rates | Ink Rates | > Than | Depleted | Spit |
| | | | | | | < Than | Degraded | Spit |
| 35-52.5 | Color | 370,021 | 740,042 | 1,027,836 | 2,220,126 | > Than | Depleted | Cap |
| | | | | | | < Than | Degraded | Spit |
| | Mono | 440,883 | 881,766 | 1,322,649 | 2,645,298 | > Than | Depleted | Cap<Spit |
| | | | | | | < Than | Degraded | Cap<Spit |
| | Color & Mono | Ink Rates | Ink Rates | Ink Rates | Ink Rates | > Than | Depleted | Cap |
| | | | | | | < Than | Degraded | Spit |
| >52.5 | Color | 370,021 | 740,042 | 1,027,836 | 2,220,126 | > Than | Depleted | Cap |
| | | | | | | < Than | Degraded | Spit |
| | Mono | 440,883 | 881,766 | 1,322,649 | 2,645,298 | > Than | Depleted | Cap<Spit |
| | | | | | | < Than | Degraded | Cap<Spit |
| | Color & Mono | Ink Rates | Ink Rates | Ink Rates | Ink Rates | > Than | Depleted | Cap |
| | | | | | | < Than | Degraded | Spit |

Fig. 3

ADAPTIVE PRINT HEAD MAINTENANCE

FIELD

This invention relates to the field of ink jet printing. More particularly, this invention relates to increasing the useful life of a print head under certain circumstances.

INTRODUCTION

A typical ink jet printer includes electronics for the control of the print operations (generally referred to herein as a printer controller), some type of print substrate handling mechanism (typically for paper), and a printer cartridge, referred to as a print head herein, including ink jet nozzles, ink reservoirs, and so forth. In many applications, the print head is replaceable and designed to have a service life that is relatively shorter than the other components of the ink jet printer.

Before a print job is started, the print head is typically disposed in a designated park position, which is the default position for the print head when it is not in use. While parked, a capping mechanism engages the print head, and seals off the print nozzles on the print head from the ambient atmosphere, so that the ink in the nozzles doesn't dry out and clog the nozzles. When the print job starts, the print head is uncapped, wiped, and goes through an initial ink-clearing routine to prepare the print head for printing, where a certain amount of ink is expelled from the print head nozzles. Expressing ink from the print head is generally referred to as spitting herein. In many ink jet printers, this parking, capping, uncapping, wiping, and initial spitting routine is always performed at the end of one print job and the start of another, and once initiated cannot be broken down as to which steps are performed and which are not—they are all performed as part of a single routine once the print head is parked.

One design goal for a replaceable print head is to have a service life that is relatively longer rather than relatively shorter, without compromising the quality of the image produced by the print head. Another goal is to have the cost of the print head in balance with its service life.

Knowing that the print head will, at some point, be disposed of, materials and tolerances for the print head are designed to operate well over a predicted service life, with some amount of design buffer so that the print quality does not degrade appreciably before the end of the anticipated service life, but not to last significantly longer than that. Otherwise, one or both of the manufacturer and the user are paying more for the print head than is necessary. To those ends, certain assumptions and design considerations are made by the manufacturer of the print head.

For example, one consideration is the size of each print job that the user will print. All things being equal, a user will get more print jobs out of a print head if those jobs are relatively smaller (fewer pages), and will get fewer print jobs out of a print head if those jobs are relatively larger (more pages), even though the total number of pages printed over the service life of the print head may be about the same under either scenario.

As described above, the print head is wiped between each print job, so the print head that is used for a greater number of print jobs will be wiped more times than the print head that is used for a fewer number of print jobs. This is important, because wiping wears out and degrades both the print head and the wiper, both of which are designed to be used in the wiping process only a given number of times before the print quality starts to diminish as a result of that wear.

For print heads that are used to print jobs with larger than anticipated page counts, a fewer number of wipes are performed than the system is designed for, and there is no problem in this regard. But for those print heads that are used to print jobs with smaller than anticipated page counts, a greater number of wipes are performed than the system is designed for, and there might be a problem with a degradation of the print quality due to excessive wear of the wiper and the print head. In the extreme, such as where every print job is only one page in length, this problem of wear of the print head and the wiper might be similarly extreme.

There is another factor that can compound this problem of wear of the print head and wiper, which factor is the print density of each page that is printed. If the print density is extremely high (lots of ink put onto each page), then the print head might run out of ink before the anticipated number of wipes has been performed, even if every print job is only one page long. However, if the print density is extremely low (very little ink put onto each page), then the print head will probably not run out of ink until an unusually large number of pages has been printed, and the anticipated number of wipes might be exceeded.

These issues compound when both the page count of a print job is very low (such as one page) and the print density of those pages is also very low (very little ink put on each page). These issues are further compounded when the ink reservoir of the print head is relatively larger, such as in a so-called extended life ink capacity print head. With that combination of factors, the number of wipes performed on the print head increases even further, and the probability of degrading the printing due to wear of the print head and the wiper commensurately increases.

In addition to the problem of wear on the print head and the wiper due to an increased number of print jobs, each one of those parking routines also comes with a spitting operation that might be more than what is needed to keep the nozzles of the print head cleared, and thereby might waste more ink than is necessary to maintain the desired print quality.

What is needed, therefore, is a system that reduces issues such as those described above, at least in part.

SUMMARY

The above and other needs are met by a method of operating an ink jet printer with an included printer controller, where the ink jet printer prints using a replaceable print head that includes a nozzle plate and an ink reservoir. The printer controller tracks a usage of ink from the ink reservoir and a number of completed nozzle plate wiping operations. The print controller determines, prior to initiating each nozzle plate wiping operation, whether to initiate an interlayer spitting operation instead of the nozzle plate wiping operation. The printer controller initiates the determined one of the wiping operation and the spitting operation.

In this manner, the ink consumption budget and the wiping budget for the print head are used in a balanced manner, and neither is consumed further ahead of the other than necessary.

In various embodiments, the determination is made based at least in part on a projection of whether the ink in the ink reservoir will be exhausted prior to the nozzle plate being wiped a predetermined number of times. In some embodiments, the projection is based at least in part on an average number of ink drops expended per printed page. In some embodiments, the projection is based at least in part on an average number of printed pages per print job. In some embodiments, the determination is made based at least in part on whether an initial spitting operation associated with the nozzle plate wiping operation will consume more ink than a projected amount of ink consumed by the inter-layer spitting operation. In some embodiments, the projected amount of ink consumed by the inter-layer spitting operation is based at least in part on a projected printer idle time between an immediately preceding print job and a next succeeding print job. In some embodiments, the projected printer idle time is based at least in part on an analysis of prior printer idle times.

In some embodiments, the print head includes a plurality of ink reservoirs, and the determination is made based at least in part on a projection of whether the ink in any one of the ink reservoirs will be exhausted prior to the nozzle plate being wiped a predetermined number of times. In some embodiments, the usage of ink from the ink reservoir is tracked by counting every drop of ink expelled by the print head. In some embodiments, the usage of ink from the ink reservoir is tracked by counting an average number of drops of ink expelled on each page printed by the ink jet printer. In some embodiments, the usage of ink from the ink reservoir is tracked by comparing each printed page to an ISO standard printed page.

In some embodiments, the number of completed nozzle plate wiping operations is tracked by counting actual nozzle plate wiping operations. In some embodiments, the number of completed nozzle plate wiping operations is tracked by counting a number of print jobs completed on the ink jet printer. In some embodiments, the number of completed nozzle plate wiping operations is tracked by counting a number of pages printed on the ink jet printer.

According to another aspect of the invention there is described a program disposed on a non-volatile memory, that when executed by a printer controller of an ink jet printer causes the ink jet printer to (a) track a usage of ink from an ink reservoir and a number of completed nozzle plate wiping operations, (b) determine, prior to initiating each nozzle plate wiping operation, whether to initiate an inter-layer spitting operation instead of the nozzle plate wiping operation, and (c) initiate the determined one of the wiping operation and the spitting operation.

According to yet another aspect of the invention there is described an ink jet printer that prints using a replaceable print head that includes a nozzle plate and an ink reservoir. A printer controller tracks a usage of ink from the ink reservoir and a number of completed nozzle plate wiping operations. The printer controller determines, prior to initiating each nozzle plate wiping operation, whether to initiate an inter-layer spitting operation instead of the nozzle plate wiping operation, and initiates the determined one of the wiping operation and the spitting operation.

DRAWINGS

Further advantages of the invention are apparent by reference to the detailed description when considered in conjunction with the figures, which are not to scale so as to more clearly show the details, wherein like reference numbers indicate like elements throughout the several views, and wherein:

FIG. 3 is a table that depicts a compilation of data to determine when to have a print head park or spit between jobs, according to an embodiment of the present invention.

DESCRIPTION

According to various embodiments of the present invention, a balance is struck in the operation of a print head, such that it is not capped and wiped an excessive total number of times between print jobs. If it appears that the combination of the number of print jobs and the ink utilization will cause the print head to be capped and wiped an excessive number of times, then instead of parking the print head between jobs—which invokes the wiping routine—the print head is sent to a position where it can instead spit ink according to a given schedule until the start of the next job.

Further, even if it appears that the utilization of the print head will not exceed the maximum desired number of wipes, if the length of time between print jobs is brief enough that the spitting routine that is used in place of the capping procedure might use less ink than the spitting routing that is used after the capping procedure, then once again the spitting routing might be invoked instead of the capping procedure. In other words, a spitting routine is used in place of a capping procedure in certain circumstances, so as to increase the life of the print head without degrading the print quality.

Figure 4:
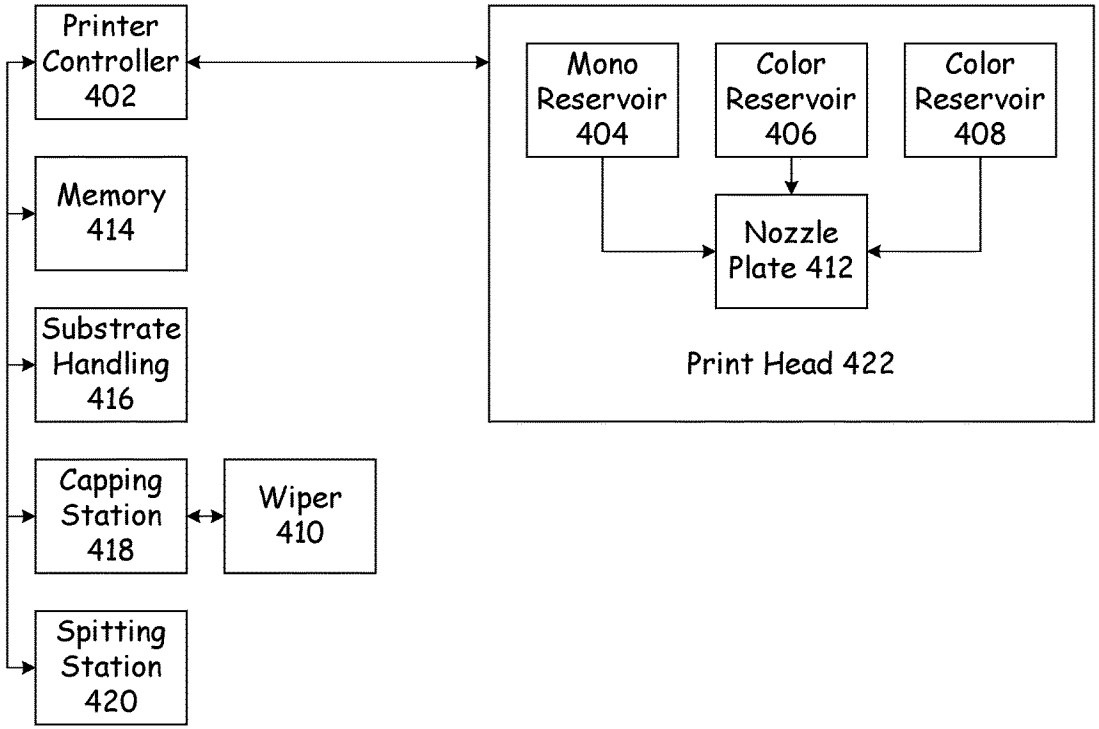
FIG. 4 is a functional block diagram of an ink jet printer according to an embodiment of the present invention.

With reference now to FIG. 4, there is depicted a functional block diagram of an ink jet printer according to an embodiment of the present invention. The ink jet printer includes a printer controller 402 that provides for the control and operation of the ink jet printer and the various components of which it is comprised. A memory 414 holds operational information and routines, downloaded image data, computed information, and tracked information. The substrate handling module 416 includes structure for moving the printed substrate, such as paper, relative to the print head 422. The capping station 418 includes a wiper 410, and is optionally used between print jobs to keep the nozzle plate 412 of the print head 422 from becoming clogged. The spitting station 420 is used to clear the nozzle plate 412.

The print head 422 includes a nozzle plate 412 that is used to expel ink from the ink reservoirs 404, 406, and 408 onto the printed substrate. It is appreciated that the print head 422 in various embodiments has as few as one and perhaps many more ink reservoirs. these ink reservoirs might all be the same color, might be duplicates of some colors and not others, and so forth. Other embodiments of ink jet printers and print heads are also comprehended herein.

Figure 1:
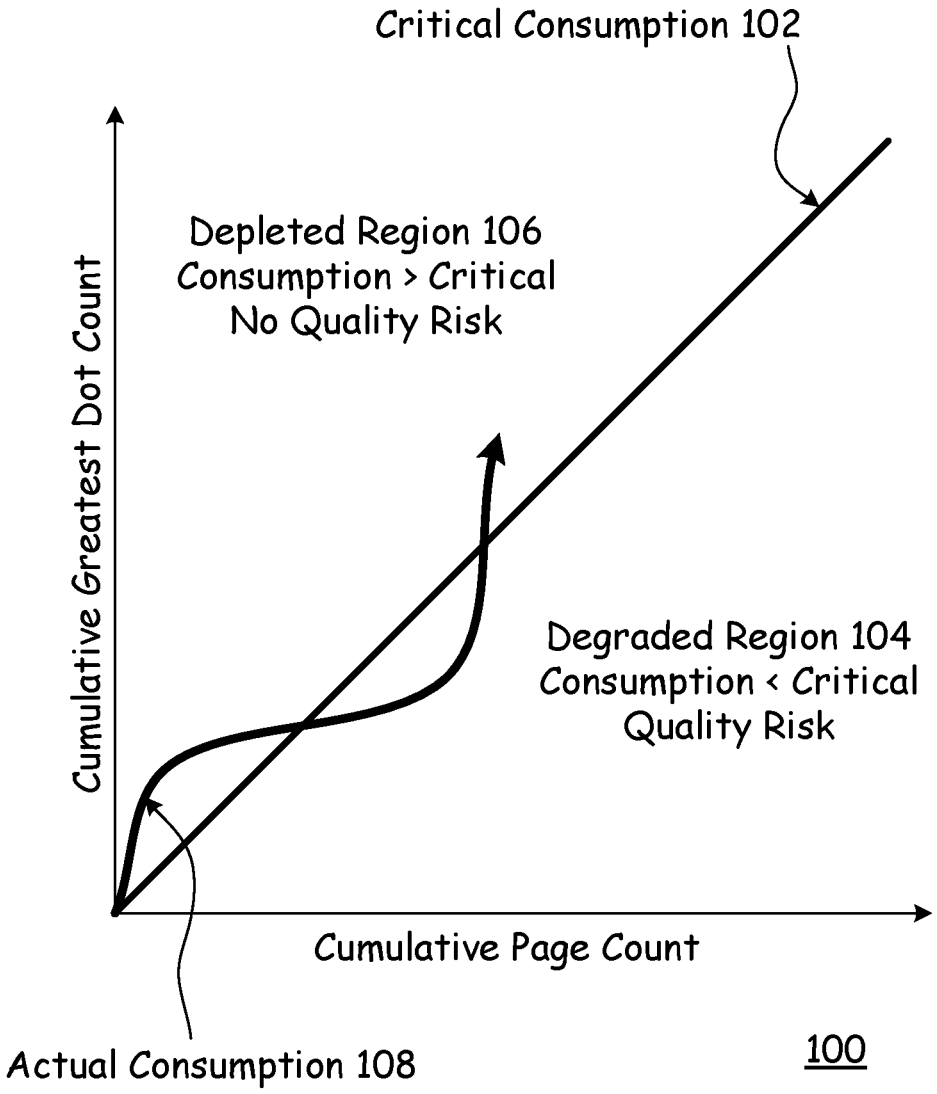
FIG. 1 is a graph that depicts cumulative ink drop count versus cumulative page count, with a critical consumption line that divides the chart into a depleted region and a degraded region, with an example of an actual consumption line plotted thereon, according to an embodiment of the present invention.

With reference now to FIG. 1 there is depicted a graph 100 that depicts cumulative ink drop count on the Y axis versus cumulative page count on the X axis, with a critical consumption line 102 that divides the graph 100 into a depleted region 106 and a degraded region 104, with an example of an actual consumption line 108 plotted thereon, according to an embodiment of the present invention. The graph 100 is helpful in the discussion below for visualizing how the decision is made as to whether to have the print head cap or spit between print jobs.

It is noted that the graph 100 would look somewhat different for different print heads, because different print heads tend to be manufactured with different anticipated lifespans in terms of the number of wipes that they can typically endure on average before print quality tends to be affected. Further, the amount of ink that a given print head holds also affects how the chart 100 looks, because a print head that holds more ink would tend to get wiped more than one that holds less ink. Finally, even the formulation of the ink that is used by a print head will affect the particulars of the chart 100. For example, some formulations of monochrome (black) ink tend to lubricate the print head more than other formulations of color inks (cyan, magenta, or yellow, for example), and thus a print head expelling black ink might be able to endure a great number of wipes, for example, than a print head that expels color inks.

So, in the discussion below an example is used of a particularly rigorous application for a specific set of print heads, which application is especially well suited for describing the application and benefits of various embodiments of the present invention. However, it is appreciated that this example is only for the purposes of description, and that other print heads and applications can also be used with various embodiments of the present invention.

For example, certain printers can be used to create a three dimensional model of an object by printing the visible outer edges of the object on successive sheets of material (such as paper) that are then glued one on top of another and cut, until the remaining portions of the printed sheets form a solid model of the object. In this application, each print job includes only one page, which constitutes the peripheral border of the object at that particular layer. Because the modeled object tends to be much thicker than a single piece of paper, producing the object might require thousands of print jobs, and each print job uses very little ink—only enough to print the outline of the object at that layer.

Thus, in this 3D printing application, a print head would be capped and wiped thousands of time for each model that is produced, but only a very little bit of ink would be used, and the print head and wiper would be physically compromised by mutual erosion long before the print head would run out of ink. In this manner, the print head would exceed the designed number of wiping operations, and the quality of the printing produced by the print head would be unacceptably degraded long before the ink was consumed, which is the typical end of life for a print head. Therefore, such a 3D printing operation is a good candidate for the application of an embodiment of the present invention.

According to the embodiment depicted in FIG. 1, a critical consumption line 102 is computed for the specific print head. The critical consumption line 102 defines a relationship between the greatest cumulative number of dots or drops of ink that have been expelled from any one of the ink reservoirs of the print head (Y axis), and the cumulative number of pages that have been printed using the print head (where, in the present example, each page constitutes a print job, and would typically invoke a cap, wipe, and spit routine).

So, for example, for a print head that has four reservoirs—one each for cyan, magenta, yellow, and black, for example—the printer controller keeps a running total of every single drop of ink that is expelled, categorized by the ink color. The printer controller also knows how many drops of ink of each color are available in each reservoir at the beginning of the print head service life. These values can either be actual or calculated.

Thus, at any given point in time, the printer controller knows which ink reservoir is currently more depleted than the others. While the designation of which ink reservoir that is might change from time to time, whichever one it is is used for the cumulative greatest dot count tally on the Y axis of the graph 100 in FIG. 1. In some embodiments only the color inks are tracked, and in other embodiments only the black ink is tracked. In some embodiments all of the inks are tracked. Obviously, other colors of ink and print heads with a greater or lesser number of ink reservoirs are also contemplated.

The critical consumption line 102 is calculated in advance of printing for a given print head. In some embodiments the necessary information about each print head is provided to the printer controller so that the printer controller can compute the critical consumption line 102, when it identifies an installed print head. In other embodiments the specifications that define the critical consumption line 102 are provided to the printer controller, such as in a chart of critical consumption lines 102, and the proper critical consumption line 102 is selected by the printer controller when it identifies an installed print head. Other methods of enabling the printer controller to have access to the appropriate critical consumption line 102 are also contemplated.

Regardless of where the computation of the critical consumption line 102 occurs, it is computed by inputting the amount of ink in a given reservoir, as expressed in the number of expelled drops through the print head in question, and the number of wipes that the print head is designed to withstand before print quality is degraded.

For example, each reservoir in a given print head might have a capacity of (filled with) 1,000,000 drops of ink. The wipe capacity that the print head designers have specified might be 1,000 wipes, before there is a concern that the print quality of the print head will start to degrade. The critical consumption line 102, in this example, is drawn as a straight line from the origin of the graph 100 through the point that represents 1,000,000 drops of ink on the Y axis and 1,000 pages on the X axis.

That point represents the end of life for the print head. At that point, either (a) one of the ink reservoirs is out of ink, or (b) the maximum number of wipes has been performed. In either case, print quality would tend to be degraded by using the print head further. For example, even if no wipes had been used because of an extremely large print job, if one of the reservoirs is out of ink, then print quality is degraded. Alternately, even if all of the ink reservoirs have most of their ink remaining, if the wipe budget has been exceeded, then print quality is degraded.

In the present example, where each page is its own print job and a wipe is invoked after each page, page count is synonymous with wipe count. In other embodiments, page count is not synonymous with wipe count, and some kind of measurement must be used to equate page count and wipe count. One measurement that could be used is the ISO standard of five pages per job, where job count is synonymous with wipe count. In this example, the critical consumption line 102 would initially be plotted at (5,000, 1,000,000), because 5,000 pages would be projected as incurring 1,000 wipes. Further, the ISO standard for the number of drops of a given ink on a standard page could also be used to correlate the values plotted on the chart 100.

However, the actual use of the print head in such a scenario might not actually be the ISO standard of five pages per job. Thus, the printer controller, in some embodiments, keeps track of the number of pages in each job, either over the entire life of the print head or for the last given number of jobs, and updates the projected number of pages that will consume the maximum recommended number of wipes, and updates the end point of the critical consumption line 102 accordingly.

So, if the number of pages per job tends to increase over the anticipated number of pages per job, whether that be one, five, or some other number, the slope of the critical consumption line 102 will flatten out, because the number of pages that can be printed before the wipe count exceeds the design maximum increases.

Alternately, if the number of pages per job tends to decrease over the anticipated number of pages per job, the slope of the critical consumption line 102 will become steeper, because the number of pages that can be printed before the wipe count exceeds the design maximum decreases.

Specifying the critical consumption line 102 can be made once at the beginning of the service life of the print head, or it can be adjusted at predetermined intervals during the service life of the print head, or it can be continually updated across the entirety of the service life of the print head, in various embodiments.

Once the critical consumption line for a given print head is computed, the area 106 above the critical consumption line 102 is designated as the depleted region 106. If the print head is operating in this region of the chart 100, as indicated by the total number of drops that have been expressed from the most-used ink reservoir of the print head versus the total number of pages that have been printed, it is an indication that the print head is being operating in a depletion mode. In other words, it means that at least one of the ink reservoirs will probably be depleted before the maximum number of wipes is performed. This is a good area in which to operate, because it means that there is no anticipated risk of degraded print quality because of excessive wiping of the print head over the anticipated service life of the print head. To say it yet another way, it means that the ink will run out before the wipes will run out, and no degraded print quality will be encountered.

The area 104 below the critical consumption line 102 is designated as the degraded region 104. If the print head is operating in this region of the chart 100, as indicated by the total number of drops that have been expressed from the most-used ink reservoir of the print head versus the total number of pages that have been printed, it is an indication that the print head is being operating in a potentially degraded mode. In other words, it means that none of the ink reservoirs will probably be depleted before the maximum number of wipes is performed. This is an undesirable area in which to operate, because it means that there is an anticipated risk of degraded print quality because of excessive wiping of the print head over the anticipated service life of the print head. To say it yet another way, it means the wipes will run out before the ink runs out, and degraded print quality will be the result.

It is noted that operation of the print head in the depleted region 106 does not mean that the ink has already been depleted. Instead, it means that the past history of use of the print head indicates that the ink in one of the reservoirs will probably deplete prior to the wipe budget being depleted, assuming that the future use of the print head is similar to the past use of the print head.

Similarly, operation of the print head in the degraded region 104 does not mean that the print quality has already been degraded. Instead, it means that the past history of use of the print head indicates that the wipe budget will probably be depleted prior to depleting the ink in any of the reservoirs, assuming that the future use of the print head is similar to the past use of the print head.

Thus, the operation of the print head is monitored during its service life, such as by the printer controller, to determine at various points in time the region 104 or 106 in which it is operating. This operational history can also be plotted on the chart 100 as the actual consumption line 108. As depicted in FIG. 1, the actual consumption line 108 is not necessary a straight line, and in most applications, would probably not be, as neither print jobs nor pages tend to use the exact same amount of ink from one to the other.

It is noted that in some embodiments, actual plotting of these values and positions is not needed. In some embodiments, these values are merely held in a memory and compared one to another as needed. Thus, the plot 100 of FIG. 1 is presented for the purposes of demonstration and description.

In the example depicted in FIG. 1, the actual consumption line 108 follows some kind of trail that might cross back and forth across the critical consumption line 102 between the depleted region 102 and the degraded region 104. In some embodiments the actual consumption line 108 is updated continuously so that the operation of the print head is always known, as to which region 104 or 106 it is in. In other embodiments the actual consumption line 108 is updated at discrete intervals, such as at the end of a print job or otherwise.

Thus, some embodiments of the present invention include a mathematical computation of a critical consumption line 102, and actual tracking 108 of the print head usage, to determine whether the operation of the print head is above the critical consumption line 102 in the depleted region 106, or below the critical consumption line 102 in the degraded region 104. The discussions above describe various ways in which those computations and trackings can be performed. Other methods are also contemplated herein.

As previously mentioned, most print heads run out of ink long before the wipe capacity is attained, but in the tortuous scenario described above, it is highly likely that the wipe capacity will be exceeded long before any one of the ink reservoirs is depleted, and if the print head remains in service, print quality might start to degrade at some point in time.

One way to avoid that situation from happening would be for the print controller, for example, to keep track of the number of wipes, and issue a warning when the critical wipe count is attained. In this manner the user could decide if the print head should still be used or not. Another way would be for the print controller, for example, to lock out any further use of the print head when the critical wipe count is attained. However, both of these methods might cause the print head to be discarded before any of the ink reservoirs have run out of ink, which means that the print head has not provided the value that it otherwise could have.

Thus, according to a further aspect of the present invention, the print controller, for example, operates the print head in different modes at different times, based at least in part upon in which of the depleted region 106 or degraded region 104 the print head is currently operating.

For example, at the end of a given print job, the print head would typically be put into the parking routine, where it is sent to the parking area, capped, wiped, and caused to perform its initial spitting routine prior to commencing the subsequent print job.

If, however, the print head is currently operating in the degraded region 104, it means that the print head is running out of wipes faster than it is running out of ink. Thus, entering the parking routine that consumes yet another one of the wipes would be counterproductive to the service life of the print head. Thus, in some embodiments, the parking routine is not invoked. Instead, the print head is sent to the position where the initial spitting routine is performed, and under the direction of the print controller, for example, is caused to spit according to—what is called herein—an inter-layer spitting schedule, which is described in more detail below.

While this inter-layer spitting routine might consume more ink than the capping, wiping, and initial spitting routine would, the status of the print head in the degraded region 104 indicates that the print head is, in effect, ink-rich and wipe-poor, which means that spending extra ink so as to not consume additional wipes is a good trade, and will, in the long run, tend to extend the service life of the print head.

On the other hand, if the operation of the print head at the end of a given print job is found to be within the depletion region 106, it means that the print head is running out of ink faster than it is running out of wipes (ink-poor and wipe-rich). Thus, entering the parking routine that consumes another wipe would not tend to reduce the service life of the print head at all.

Thus, when the operation of the print head is in the degraded region 104, the print head enters a spitting routing instead of the normal parking routine. When the operation of the print head is in the depleted region 106, the print head might enter the normal parking routine. More on the operation of the print head in the depleted region 106 is given at a later point below.

The operation of the inter-layer spitting route described above can take different forms in various embodiments. For example, in some embodiments a given number of ink drops are expelled from each nozzle in communication with each ink reservoir of the print head over a given length of time. In this manner, all of the nozzles are kept moist, and none of the nozzles develop viscous plugs of dried or partially dehydrated ink solids. The expression of ink from the nozzles can be accomplished, in various embodiments, all at the same time, or in some kind of rotation. It can be performed for the nozzles in communication with some of the ink reservoirs, but not others, to account for the fact that some inks evaporate more slowly than others. It can be done for different ink reservoirs according to different schedules, again to account for the differences in evaporation rates. Other inter-page spitting schedules are also comprehended.

However, while it is disadvantageous to wipe the print head more times than it is designed for prior to it running out of ink, there is no disadvantage to wiping the print head fewer times than it is designed for prior to running out of ink. Therefore, if the print head is operating in the depletion region 106, where there is no harm in using the parking routine and consuming another wipe, there might still be other reasons for not entering the parking routing.

A mentioned above, the parking routing also invokes an initial spitting operation that consumes a known quantity of ink. If the length of time between print jobs is relatively short, it might consume less ink if the print head were to just go to the spitting station and spit according to the inter-layer spitting routine during that relatively brief period of time, rather than to enter the parking routine and consume all of the ink dictated by the initial spitting routine. In other words, having now defined this new inter-layer spitting routine that takes the place of the capping routine, it might be useful in more than one situation.

On the other hand, if the length of time between print jobs is relatively long, it might consume less ink if the print head were to enter the parking routine, because the initial spitting operation would tend to consume less ink than the inter-layer spitting schedule during the relatively longer break.

However, knowing the length of the next break between print jobs constitutes predicting the future, and is imperfect in most instances. However, in some operational modes, such as the 3D printing application described above, and others, the past operation of the printer can provide a good estimated of the future operation of the printer. Thus, according to some embodiments of the present invention, the length of time between print jobs is tracked, such as by the printer controlled, and the historical data is used to predict the length of time before the next print job commences.

Many different routines could be used for this prediction process, such as tracking the length of a given number of prior print breaks, and using an average of that number as an estimate of the length of the next print break. For example, the prior ten print breaks could be measured and averaged to predict the length of the next print break. Alternately, a regression could be performed on a given number of print breaks to predict the length of the next print break. Further, additional statistical tools could be employed, such as using statistical analysis to throw out statistical outliers in the prior print break data so that they don't skew the prediction. Other statistical processes are also contemplated.

Regardless of the method used to predict the length of the next print break, the predicted length of time is analyzed to determine whether more ink is consumed by the inter-page spitting routine or the initial spitting routing that is a standard part of the parking process. The one that consumes the less ink is selected, such as by the printer controller, and the print head is sent to the proper location for the selected routine.

Figure 2:
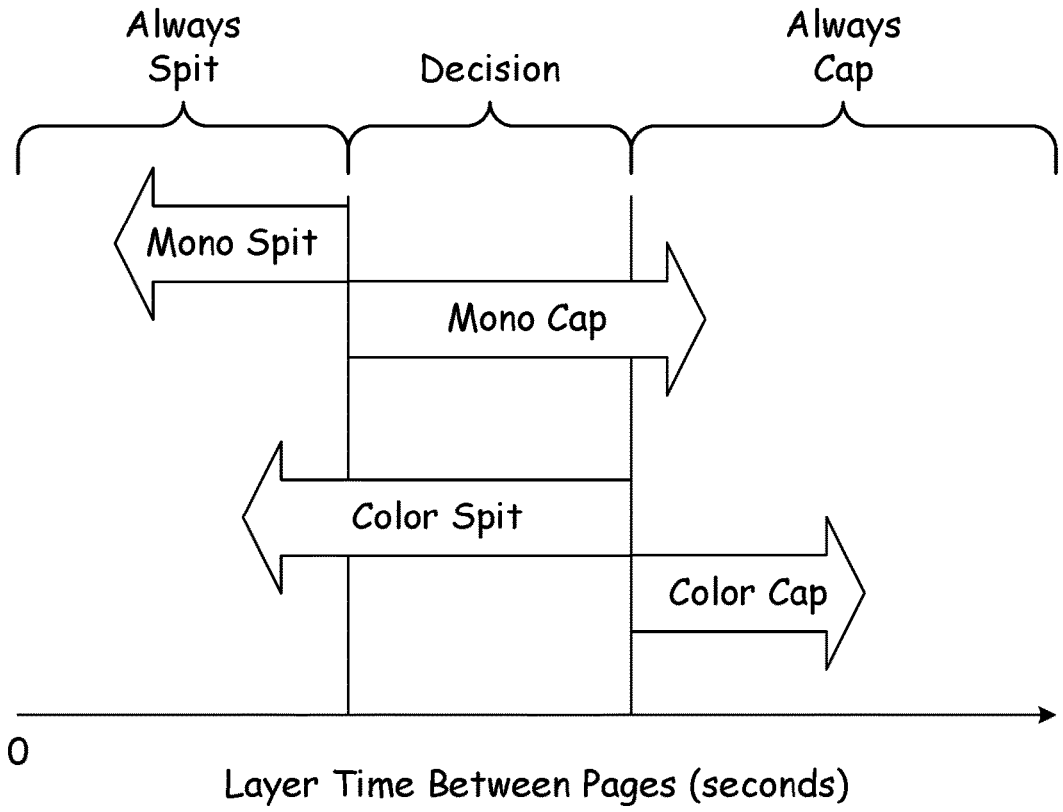
FIG. 2 is a graph that depicts critical points for capping or spitting based on layer time between print jobs, according to an embodiment of the present invention.

A visual depiction of this is presented in FIG. 2. The X axis of the plot of FIG. 2 depicts the predicted layer time between a preceding and succeeding page (in some cases) or print job, such as in seconds. The two vertical lines represent the break points between where the known ink consumption of the capping routine is substantially the same as the computed ink consumption of the inter-layer spitting routine (as described above). Where the layer time is less than the break point, less ink is consumed by spitting than by capping. Where the layer time is greater than the break point, less ink is consumed by capping than by spitting.

In FIG. 2 there are two vertical break lines, which in the embodiment depicted represent one line for black ink and another line for color ink. This indicates that there might be a difference in the amount of ink that is consumed in one or more of the capping routine and the inter-layer spitting routine for different types of inks. In some embodiments, there might be a different line for all colors and types of ink. In other embodiments there might only be one break line, as all inks are consumed by the two routines in the same way. Other such scenarios are also contemplated.

In the embodiment depicted in FIG. 2, the black or monochrome ink has a different break point than the color inks (all of which have the same break point). Thus, if the anticipated layer time is less than the point at which the left-most break line is disposed, then it makes sense to not park the print head, but to instead send the print head to the spitting position and invoke the inter-layer spitting routine.

Alternately, if the anticipated layer time is greater than the point at which the right-most break line is disposed, then it makes sense to park the print head, because the parking routine will consume less of both the black ink and the color ink than the inter-layer spitting routine.

Between the two break lines there is a decision to be made, as it would consume less color ink (in this example) to perform the inter-layer spitting routine, but it would consume less black ink to perform the capping routine. Various decisions could be made in this situation. For example, the print controller could remember the decision that was made when this situation was last incurred, and just rotate back and forth between capping and spitting for each successive occasion of the layer time being between the two break points. Alternately, the printer controller could always select the inter-layer spitting routine. In other embodiments, the printer controller could always select the capping routine. Other methods of selecting which of the spitting or capping routine to select are also contemplated.

Thus, according to various embodiments of the present invention, if the print head is operating in the degraded region 104, it is sent to the inter-page spitting location to spit between pages instead of entering the parking routine. However, if the print head is operating in the depleted region 106, a determination is made as to whether less ink would be consumed by an inter-page spitting routing or the parking routine, and the printer controller, for example, causes the print head to enter whichever routine consumes the less ink. In this manner, the service life of the print head is generally extended, by not consuming all of the wipes prior to running out of ink, and by not using more ink than is necessary.

FIG. 3 depicts an example of a table that, in some embodiments, is either resident in a memory of the printer controller, or otherwise disposed in a memory that is accessible to the printer controller, and which provides information for a given set of print heads that is useful in making the operational decisions as described above.

In the table of FIG. 3 there is listed information in regard to different print heads, which have been labeled in the headings for columns 3-6 as standard fill, one extra large fill, double extra large fill, and triple extra large fill. In this example, other characteristics of the print heads are identical, and it is just the ink capacities of the reservoirs that are different. Tables for print heads having different characteristics are constructed in other embodiments, and are contemplated herein.

In the rows beneath each of columns 3-6 there is a value that represents the average dots of ink expressed per page. This is another way of expressing the critical consumption line 102 of FIG. 1. To convert between this table and the critical consumption line 102, one merely divides the total number of drops expressed (Y axis of FIG. 1) by the total number of pages (X axis of FIG. 1), which yields a number that is compared to the value in columns 3-6 of the table of FIG. 3. These values in the table are computed in the same manner as indicated above, using the designed wipe budget for the given print head, assuming that one page equals one print job (which would normally invoke one wipe), and so forth, as described above. Tables for other print head designs are contemplated herein.

To make the comparison, one first determines the project layer time as described above, or in other words, the amount of time that the print head will not be used between two print jobs. These times are computed and have the meaning as described above in regard to FIG. 2. The row with the appropriate layer time is selected, as given in column 1. This can be done automatically by the printer controller, for example, as described above.

Next is determined the type of reservoir in the print head that is being used for the critical usage comparison, as given in column 2. In the example depicted in FIG. 3, there is a choice of a combination of the color reservoirs, the monochrome reservoir, or a combination of the color and monochrome reservoirs. In other embodiments other options could be presented, such as the various color reservoirs independently, if they are independently replaceable one from another. This can be done automatically by the printer controller, for example.

Next is determined the capacity of the critical reservoir, be it standard, 1×, 2×, or 3×, as given in columns 3-6. This can be done automatically by the printer controller, for example, by identifying the print head when it is inserted into the printer. Then the actual average dots per page (taken as from the plot of the actual consumption line 108 of FIG. 2) is compared to the value in the appropriate row (as determined above) of the appropriate column 3-6 (as determined in this paragraph).

It is highly unlikely that the actual value will exactly equal the computed value in the table, and so column 7 indicates whether the actual number of dots per page is less than or greater than the tabulated value in columns 3-6. When the appropriate row is selected as given in column 7, column 8 then identifies the region in which the print head is operating, be it the depleted region 106 or the degraded region 104. This determination could be flagged in some way, but need not be explicitly identified or presented in any way. However, column 8 is convenient for present purposes to tie the information in FIG. 3 back to the discussion of FIG. 1.

The appropriate decision as to whether to cap or spit between the print job is then given in column 9. In some instances where the monochrome reservoir is in the same print head as the color reservoirs (indicated in FIG. 3 at column 2 as Mono & Color), the actual consumption rate 108 might be at a level that is in the decision region of FIG. 2, where it would make sense for the monochrome head to be capped, but for the color head to spit. But since they are both in the same print head, it must either be capped or spit, one or the other, it can't do both. In the table of FIG. 3, it is indicated that it is generally preferable to select spitting over capping. However, as mentioned above, this decision could be different depending upon various factors.

These decisions are based upon the principles described above, such as whether the printer is operating in a wipe-rich environment or an ink-rich environment, and how long the break between print jobs is anticipated to be. These decisions and computations generally enable the printer to strike a balance between the competing goals of not running out of ink while there are still wipes left to use, and not using up all the wipes while there is still ink left to use, and thus enable the printer itself to function better, and make better use of a print head.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A printer comprising:

a print head that includes a nozzle plate, an ink reservoir, a controller for, acquiring information including a usage of ink from the ink reservoir and a number of nozzle plate wiping operations, determining, prior to initiating each nozzle plate wiping operation, whether to initiate a first spitting operation instead of the nozzle plate wiping operation based on the information, wherein the determination is made based at least in part on at least one of, a projection of whether the ink in the ink reservoir will be exhausted prior to the nozzle plate being wiped a predetermined number of times, and whether an initial spitting operation associated with the nozzle plate wiping operation will consume more ink than a projected amount of ink consumed by the inter-layer spitting operation, and initiating at least one of the wiping operation and the spitting operation based on the determination.

2. The printer of claim 1, wherein the projection is based at least in part on an average number of ink drops expended per printed page.

3. The printer of claim 1, wherein the projection is based at least in part on an average number of printed pages per print job.

4. The printer of claim 1, wherein the determination is made based at least in part on whether an initial spitting operation associated with the nozzle plate wiping operation will consume more ink than a projected amount of ink consumed by the inter-layer spitting operation.

5. The printer of claim 4, wherein the projected amount of ink consumed by the inter-layer spitting operation is based at least in part on a projected printer idle time between an immediately preceding print job and a next succeeding print job.

6. The printer of claim 5, wherein the projected printer idle time is based at least in part on an analysis of prior printer idle times.

7. The printer of claim 1, wherein the print head includes a plurality of ink reservoirs, and the determination is made based at least in part on a projection of whether the ink in any one of the ink reservoirs will be exhausted prior to the nozzle plate being wiped a predetermined number of times.

8. The printer of claim 1, wherein the usage of ink from the ink reservoir is tracked by counting every drop of ink expelled by the print head.

9. The printer of claim 1, wherein the usage of ink from the ink reservoir is tracked by counting an average number of drops of ink expelled on each page printed by the ink jet printer.

10. The printer of claim 1, wherein the usage of ink from the ink reservoir is tracked by comparing each printed page to an ISO standard printed page.

11. The printer of claim 1, wherein the number of nozzle plate wiping operations is tracked by counting actual nozzle plate wiping operations.

12. The printer of claim 1, wherein the number of nozzle plate wiping operations is tracked by counting a number of print jobs completed on the ink jet printer.

13. The printer of claim 1, wherein the number of nozzle plate wiping operations is tracked by counting a number of pages printed on the ink jet printer.

* * * * *